US007921646B2

(12) United States Patent
Swenson et al.

(10) Patent No.: US 7,921,646 B2
(45) Date of Patent: Apr. 12, 2011

(54) FLUIDIC VALVE WATER DRAIN

(75) Inventors: Kendall Roger Swenson, Erie, PA (US); Anthony Holmes Furman, Scotia, NY (US); Peter Galie, Latham, NY (US); Lukas Johnson, Erie, PA (US)

(73) Assignee: General Electric Company, Schenectady, NY (US)

( * ) Notice: Subject to any disclaimer, the term of this patent is extended or adjusted under 35 U.S.C. 154(b) by 556 days.

(21) Appl. No.: 11/961,316

(22) Filed: Dec. 20, 2007

(65) Prior Publication Data

US 2009/0158733 A1 Jun. 25, 2009

(51) Int. Cl.
*F02B 33/44* (2006.01)

(52) U.S. Cl. ..... 60/605.1; 415/169.2; 137/251.1

(58) Field of Classification Search ..... 60/597–612; 123/559.2; 415/169.2, 169.4, 169.1; 55/355, 55/417

See application file for complete search history.

(56) References Cited

U.S. PATENT DOCUMENTS

| | | | | | |
|---|---|---|---|---|---|
| 2,173,333 | A * | 9/1939 | Jacobs | ..... | 60/39.17 |
| 2,866,617 | A * | 12/1958 | Land | ..... | 417/406 |
| 3,274,757 | A * | 9/1966 | Wapler | ..... | 96/359 |
| 3,362,155 | A * | 1/1968 | Driscoll | ..... | 60/39.092 |
| 3,778,194 | A * | 12/1973 | Miller et al. | ..... | 417/407 |
| 4,169,355 | A * | 10/1979 | Walsham et al. | ..... | 60/602 |
| 4,867,634 | A * | 9/1989 | Baker et al. | ..... | 415/121.2 |
| 5,620,302 | A * | 4/1997 | Garrison et al. | ..... | 415/169.2 |
| 7,347,044 | B1 * | 3/2008 | Lubenow et al. | ..... | 60/309 |
| 2007/0137201 | A1 * | 6/2007 | Arnold et al. | ..... | 60/605.1 |
| 2009/0151316 | A1 * | 6/2009 | Burkitt | ..... | 60/39.094 |

FOREIGN PATENT DOCUMENTS

| | | | | |
|---|---|---|---|---|
| DE | 102005062561 | A1 | 6/2007 | |
| JP | 05180197 | A | 7/1993 | |
| JP | 2008208787 | A * | 9/2008 | ..... 123/559.1 |
| WO | 2007068694 | A1 | 6/2007 | |

OTHER PUBLICATIONS

International Search report issued in connection with corresponding PCT Application No. PCT/ US2008/083860 on Nov. 30, 2009.

Written Opinion issued in connection with corresponding PCT Application No. PCT/ US2008/083860 on Nov. 30, 2009.

GE Turbo Water Drain Powerpoint Presentation, From the EMD Technical Training Manual.

* cited by examiner

*Primary Examiner* — Thomas Denion
*Assistant Examiner* — Douglas J. Duff
(74) *Attorney, Agent, or Firm* — GE Global Patent Operation; John A. Kramer

(57) ABSTRACT

A turbocharger is disclosed that includes a compressor, a turbine connected to the compressor by a mechanical shaft, and a fluidic drain valve in flow communication with an air bleed port of the compressor and an exhaust plenum to drain water accumulated inside the turbocharger such that water accumulated in the exhaust plenum is drained during shut-down when no air from the bleed port flows through the fluidic drain valve.

20 Claims, 5 Drawing Sheets

FLUIDIC VALVE WATER DRAIN

BACKGROUND OF THE INVENTION

1. Field of the Invention

The embodiments disclosed relate generally to water drains and more particularly to a fluidic valve water drain for a turbocharger.

2. Description of the Related Art

In reciprocating piston engines, the amount of power is controlled by the amount of fuel burned during the power stroke. For a given cylinder size, the larger the amount of air drawn in during the intake stroke, the larger the amount of fuel that can be mixed in with the intake air or introduced into the cylinder and burned, thus increasing the engine output power. Turbocharger are known devices used to increase the power output of piston engines by compressing air into the engine with a compressor driven by a turbine that harvests energy from the hot engine exhaust gases.

FIG. 1 illustrates a conventional turbocharger 10 having an axial turbine 12 and a radial compressor 14 connected to each other by a mechanical shaft 16. As understood by those of ordinary skill in the applicable arts, in operation, engine exhaust gases (as shown by arrow 18) are guided toward a plurality of blades 20 disposed on a turbine wheel 22 by a turbine inlet housing 24. Expansion of the hot exhaust gases causes the turbine 12 to turn, thus driving the compressor 14 via the mechanical shaft 16. As the compressor 14 turns, an impeller 26 draws air in at the compressor inlet (as shown by arrow 28) and delivers the same to a diffuser 30 disposed inside a compressor housing 32, slowing down the high velocity air, thus converting its kinetic energy to pressure. The pressurized air is then fed into the engine during the intake stroke. The exhaust gases leave the turbine 12 via an exhaust passage 34, after expanding through the blades 20 of the turbine wheel 22. As understood by those of ordinary skill, turbochargers with radial turbines and/or axial compressor may exist and the particular combination illustrated in FIG. 1 is exemplary in nature and in no way limits the scope of the subject matter disclosed herein.

Over time, as turbocharged piston engines operate, some of the additives in the lubricating oil are deposited on the turbocharger turbine nozzle ring and turbine wheel blades 20 (also referred to as buckets). These hard deposits contain calcium sulfate, among other constituents, and, with time, tend to become thicker as engine operation continues. However, despite their hardness, they tend to be readily dissolved in rainwater. Many turbocharged engines, such as those used in a locomotive engine, are designed with a simple stack or relatively open muffler directly above the turbocharger turbine. Thus, if the engine is shut down and no gas is flowing through the turbine, rainwater can accumulate around the stationary turbine parts, as illustrated in FIG. 2 by the water level identified as element 36. If the water level is high enough and the water is undisturbed for a period of time, the deposits on the turbine blades (e.g., see blade 20 in FIG. 2) partially or completely submerged in the water can be locally dissolved, leading to a significant rotor imbalance once the engine is restarted. In many cases this imbalance is sufficient to load the turbocharger bearings to the point of failure soon after a subsequent restart of the engine.

It would therefore be desirable to provide for a mechanism to drain rainwater that may accumulate in the exhaust plenum of a turbocharger with a self-cleaning device with no moving parts in order to minimize maintenance and extend turbocharger useful life.

BRIEF SUMMARY OF THE INVENTION

The fluidic valves disclosed herein provide a mechanism to drain rainwater (or snow) that can accumulate in the turbine section of an engine turbocharger if the engine is shut down for an extended period of time during which rainfall or snowfall occurs. These devices are designed to have no moving parts, but rather to utilize fluid flow to passively open a drain when the engine is not running and to provide self-cleaning and to block leakage when the engine is running. As such, a substantial reduction in turbocharger failures is expected since rainwater will not accumulate to a level in the exhaust plenum sufficient to preferentially soak the lower portion of the turbine blades during shutdown. In locomotive applications, the disclosed fluidic valves will improve locomotive availability and, by reducing the failure rate, improve the locomotive service productivity.

One or more of the above-summarized needs or others known in the art are addressed by turbochargers that include a compressor having an air bleed port, a turbine connected to the compressor by a mechanical shaft; and a fluidic drain valve in flow communication with the air bleed port of the compressor and an exhaust plenum that includes the turbine, the fluidic drain valve being configured to passively drain water accumulated in the exhaust plenum when no air from the bleed port flows through the fluidic drain valve.

Turbochargers according to the subject matter disclosed herein also include a compressor having an air bleed port; a turbine connected to the compressor by a mechanical shaft; and a fluidic drain valve that includes a first body having a first end portion in flow communication with an exhaust plenum that includes the turbine, a second body including a bore forming a flow passage, the second body being disposed inside of the first body in the second portion thereof so as to form a flow passage there between, the second body having a first end portion protruding from a second end portion of the first body, the first end portion of the second body being in flow communication with the air bleed port of the compressor, and a drain in flow communication with the second portion of the first body, the fluidic drain valve being configured to passively drain water from the exhaust plenum through the flow passage between the first and second bodies into the drain when no air from the bleed port flows through the second body, and to seal a flow of exhaust gases from the exhaust plenum into the drain when air from the bleed port flows through the second hollow body during operation.

Turbochargers according to the subject matter disclosed herein also include a compressor having an air bleed port, a turbine connected to the compressor by a mechanical shaft; the turbine being disposed inside an exhaust plenum of the turbocharger, and means for passively removing water accumulated in the exhaust plenum when the turbocharger is not in operation.

The above brief description sets forth features of the various embodiments of the present invention in order that the detailed description that follows may be better understood, and in order that the present contributions to the art may be better appreciated. There are, of course, other features of the invention that will be described hereinafter and which will be for the subject matter of the appended claims.

In this respect, before explaining several embodiments of the invention in detail, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

Further, the purpose of the foregoing Abstract is to enable a patent examiner and/or the public generally, and especially scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
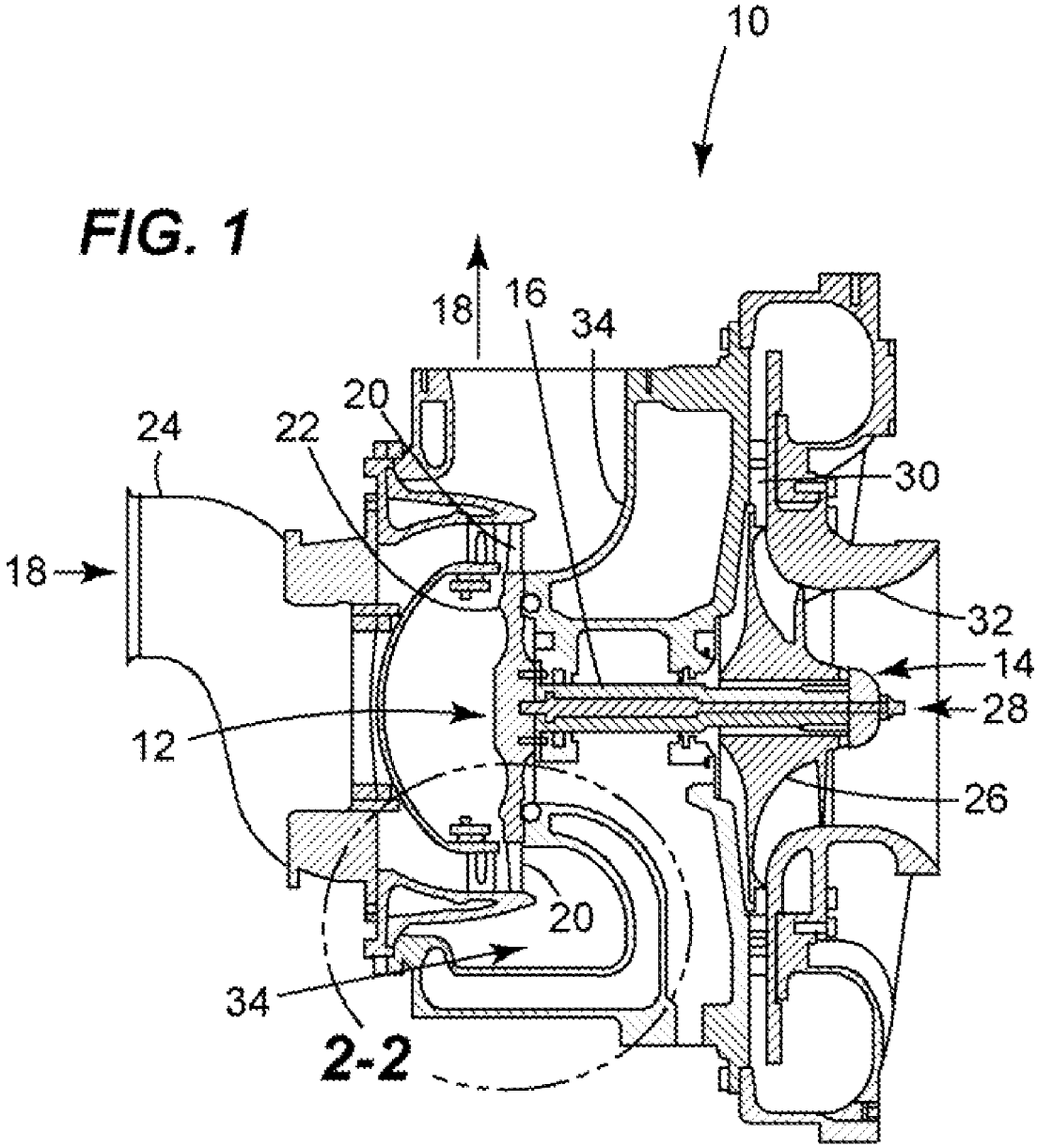
FIG. 1 illustrates a conventional turbocharger.
Figure 2:
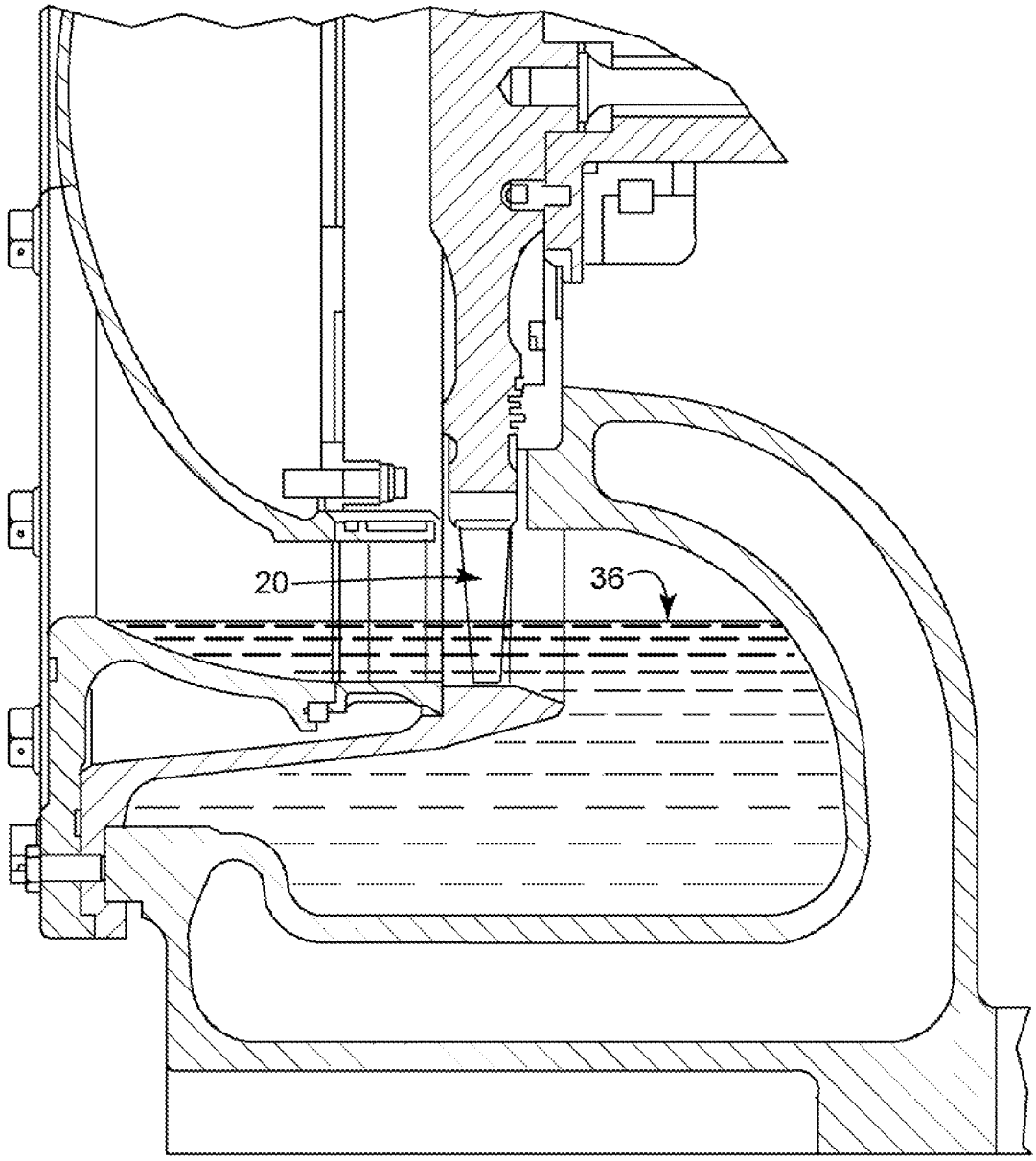
FIG. 2 is an enlargement of the portion 2-2 of the conventional turbocharger of FIG. 1.

The embodiments disclosed relate generally to water drains and more particularly to a fluidic valve water drain for a turbocharger. Referring now to the drawings, wherein like reference numerals designate identical or corresponding parts throughout the several views, several embodiments of the disclosed subject matter will be described.

Figure 3:
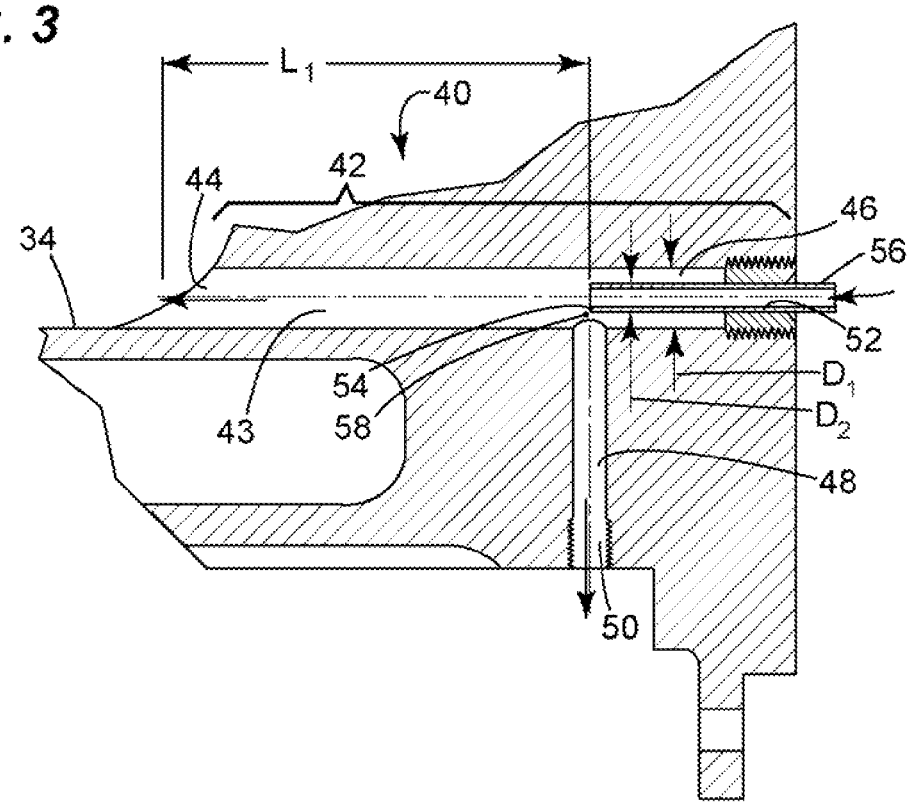
FIG. 3 illustrates an embodiment of the disclosed fluidic drain valve.

A fluidic valve 40 according to a first embodiment of the subject matter disclosed is generally illustrated in FIG. 3. As used herein throughout, the expression fluidic valve refers to the use of a fluid or compressible medium to control the motion of another fluid. The physical basis of fluidics is pneumatics and hydraulics, based on the theoretical foundation of fluid dynamics. The term fluidics is normally used when the devices have no moving parts, so ordinary hydraulic components such as hydraulic cylinders and spool valves are not referred to as fluidic devices, thus the reference made herein throughout to a passive valve, i.e., a valve without any moving parts. Thus, a fluidic valve in the context of the subject matter disclosed herein is a valve in which a given amount of air can passively control the flow of a substantially larger amount of air (i.e., control the larger amount to flow or not to flow). A non-limiting example of a device that operates on a similar principle is a fluidic amplifier.

Figure 4:
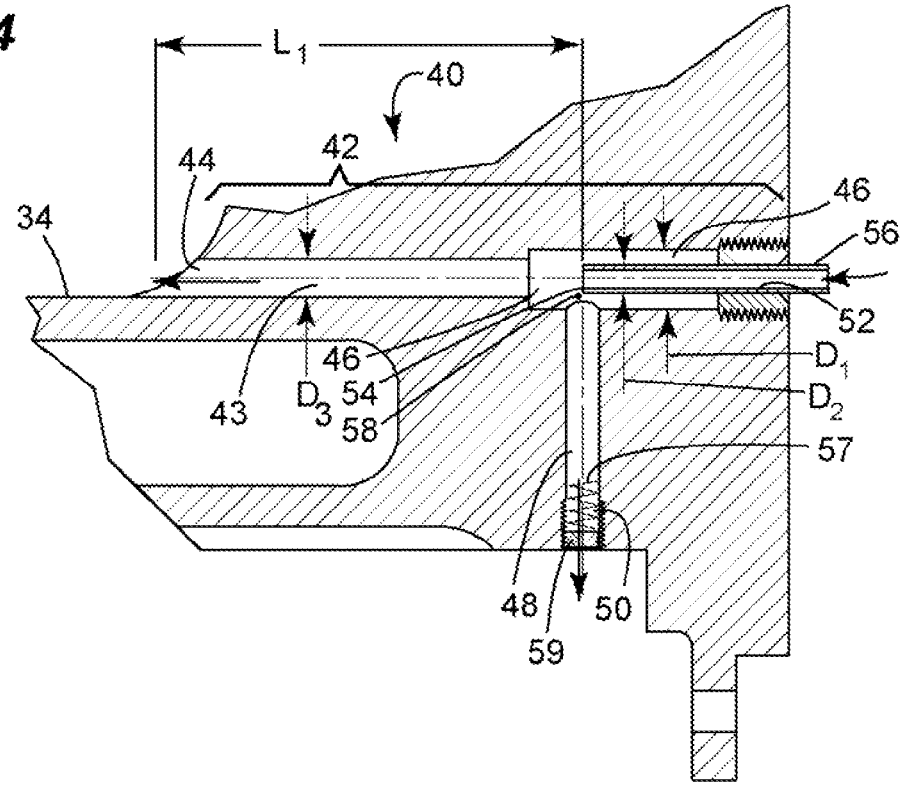
FIG. 4 illustrates another embodiment of the disclosed fluidic drain valve.

The fluidic valve 40 includes a first hollow body 42 forming a flow passage 43 therein, the main hollow body 42 having first and second end portions 44 and 46 and a drain 48 with the first end portion 44 being in flow communication with the casing or exhaust plenum 34 of the turbocharger 10 and, in the particular embodiment illustrated, the second end portion 46 being in flow communication with the drain 48 having an outlet 50. The fluidic valve 40 further includes a second hollow body 52 having first and second end portions 54 and 56 with a portion of the second hollow body 52 being partially disposed inside the first hollow body 42 so as to form an annular flow passage 58 between the two hollow bodies. The first end portion 54 of the second hollow body 52 is inserted into the first hollow body 42 so as to be positioned a distance $L_1$ from the opening of the turbine casing or exhaust plenum 24 and the second end portion 56 protrudes out from the first hollow body 42. Although FIG. 3 illustrated the second end portion 56 protruding out from the first hollow body, it should be understood by those of ordinary skill that end portion may also be flush or even sunk inside of the fitting. The second end portion 56 of the second hollow body 52 is connected to a source of pressurized gas, such as bleed air from the turbocharger compressor 14. The hollow portion of the first hollow body 42 has a characteristic dimension $D_1$ larger than a characteristic dimension $D_2$ of the second hollow body 52. In addition, the first end portion 54 of the second hollow body 52 is disposed at a distance $L_2$ (in FIGS. 3 and 4 $L_2$=0) from the drain outlet 50. The cross sectional shape of either first or second hollow bodies 42 and 52 are not critical, as long as the flow passage 58 is formed there between for the passage of the water to be drained. As such, although circular cross sections may be favored, others, such as, but not limited to, elliptical and square to name a few examples, are within the scope of the subject matter disclosed. FIG. 4 illustrates another embodiment of the fluidic valve 40 in which the first hollow body 42 includes a first portions having a characteristic diameter $D_1$ and a second portion have a characteristic diameter $D_3$, $D_1$ being larger than $D_3$, as shown.

In operation, the fluidic valve 40 provides an unrestricted drain from the turbocharger turbine area when the engine is shut down, by allowing any liquid accumulated in the exhaust plenum 34 to flow through the annular passage 58 and out the drain outlet 50. When the engine is running, the normal exhaust gas flow through the turbine section is enough to prevent accumulation of rainwater in the exhaust plenum 34. In addition, since the turbine 12 rotates during operation of the engine, even if rain does get into the exhaust plenum 34, none of the blades 20 would be preferentially soaked. When the engine power is increased, the bleed air from the turbocharger compressor 14 connected to the second hollow body 52 of the fluidic valve 40 acts as a fluidic diode to effectively prevent exhaust gas from leaking out of the drain 48. The bleed airflow through the second hollow body 52 also has the effect of purging the internal flow passages of the fluidic valve 40 of any carbon or other deposits that might have accumulated during the engine shutdown. Also, during operation, air aspirated back through the drain 48 will also keep the outlet 50 and other drain flow passages cleared of any debris accumulation.

In addition, in one embodiment of the fluidic valve 40, a course screen 59 (shown in FIG. 4) is disposed at the outlet 50 of the drain 48 in order to avoid the ingestion of foreign objects in the turbocharger 10. A biasing member 57, such as a spring, may be disposed inside of the drain 48 for support of the course screen just described. As understood by those of ordinary skill, the ability of the fluidic valve 40 to seal against exhaust backpressure increases as engine power increases. As just explained, the operation of the fluidic valve 40 is automatic and self-regulating and does not require interface with any engine control system. Air to drive the fluidic valve 40 is provided by a small bleed off the turbocharger compressor 14, either through an external line or through a passage integrated into the casing. The geometry of the fluidic valve 40 is sized such that an effective seal can be maintained against exhaust pressures for a given engine operating range at negligible loss in turbocharger performance.

Thus, as those of ordinary skill will appreciate after consideration of the subject matter disclosed herein, the fluidic valve 40 provides a mechanism to drain rainwater (or melted snow) that can accumulate in the turbine section of an engine turbocharger if the engine is shut down for an extended period of time during which heavy rainfall or snowfall occurs. The device is designed to have no moving parts, but rather to utilize fluidics to passively open the drain when the engine is not running and to provide self-cleaning and block leakage when the engine is running. As such, by use of the fluidic valve 40, a substantial reduction in turbocharger failures is expected since rainwater and/or molten snow will not accumulate substantially in the exhaust plenum 34 to preferentially soak a few of the blades 20. In locomotive applications, the fluidic valve 40 will improve locomotive availability and, by reducing the failure rate, improve the locomotive service productivity.

Figure 5:
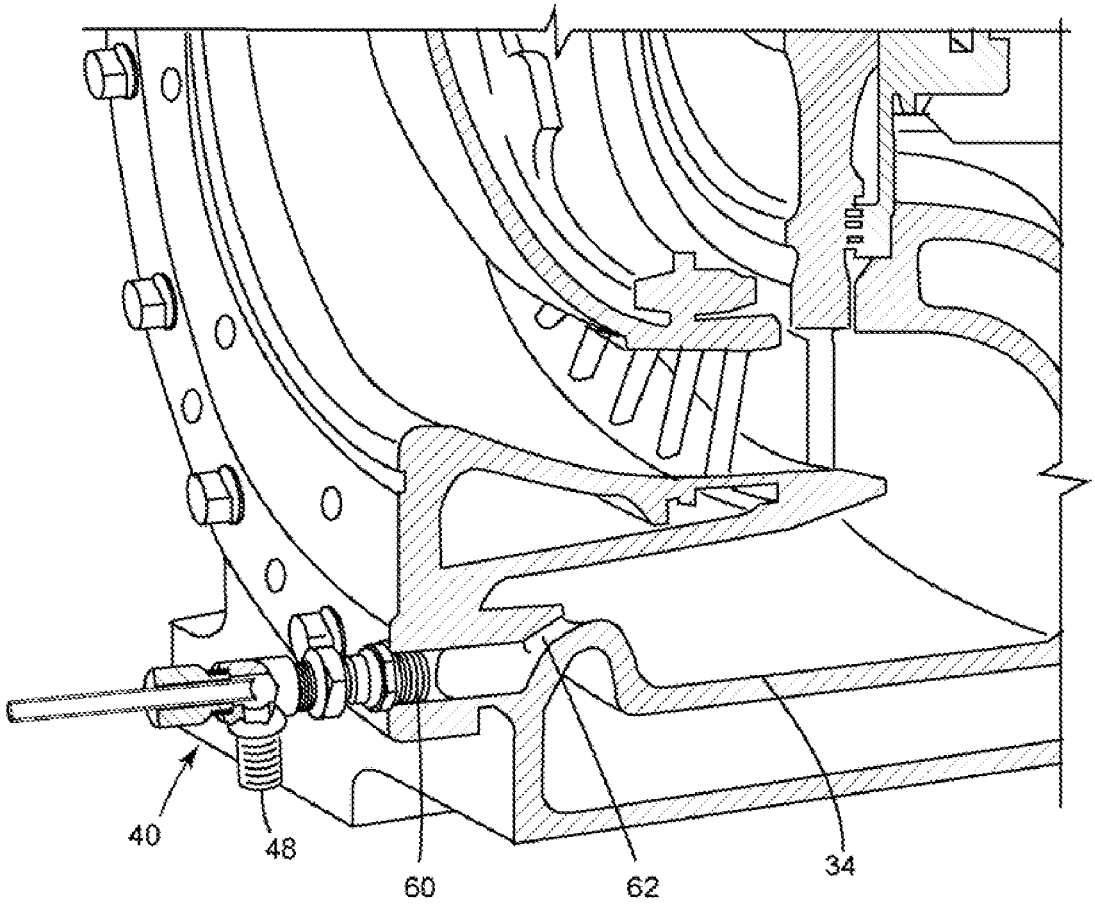
FIG. 5 illustrates the fluidic drain valve of FIG. 3 externally mounted to a turbocharger.
Figure 6:
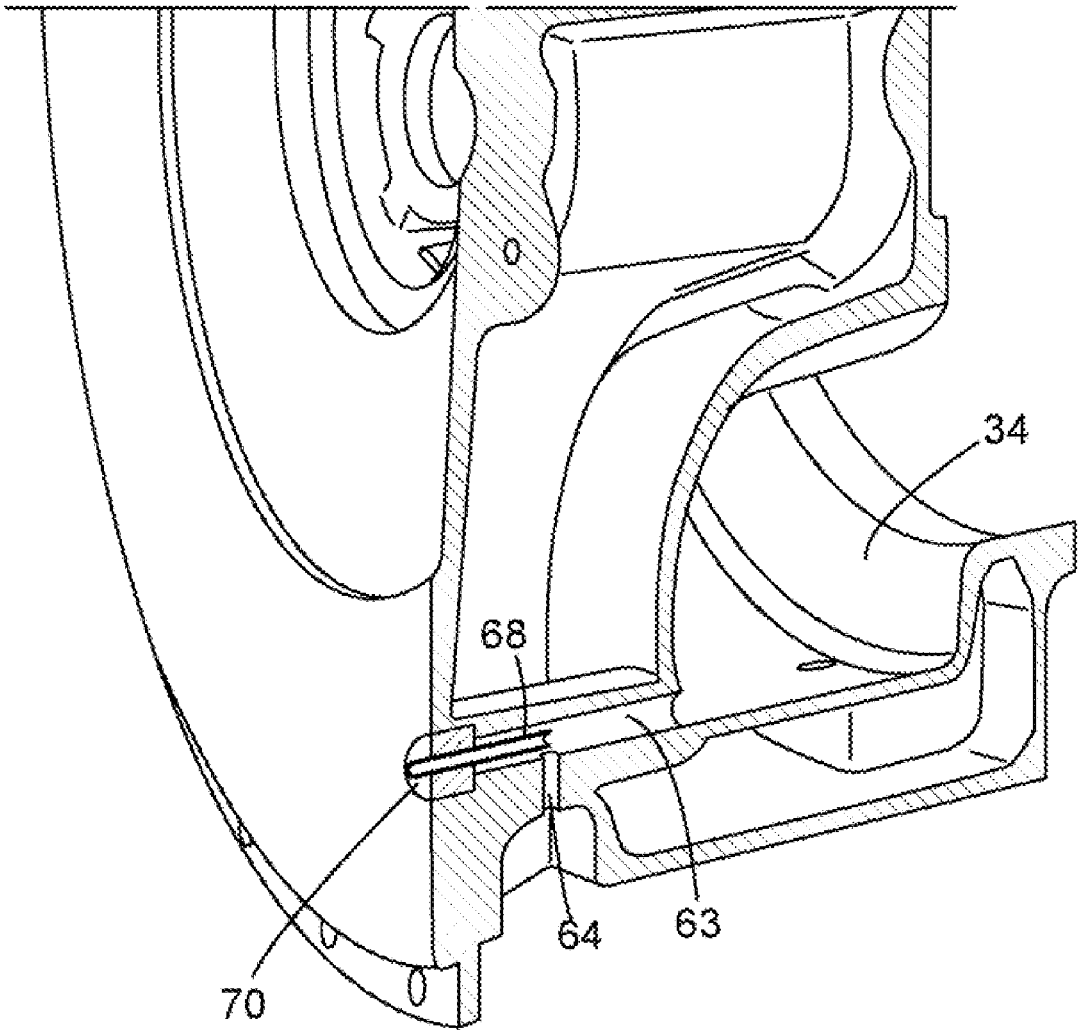
FIG. 6 illustrates the fluidic valve of FIG. 3 as an integral part of a turbocharger.

FIGS. 5 and 6 illustrate two exemplary embodiments of how the fluid valve 40 may be disposed on the turbocharger 10. In FIG. 5, the fluidic valve 40 is used as an external device, or cartridge, mounted to the turbocharger 10 through an access opening 60 to which the fluidic valve 40 maybe connected by any known ways, including, but not being limited to, threads, welding, press fit, to name a few. The access opening 60 further includes a passage 62 connecting the access opening 60 to the exhaust plenum 34 of the turbocharger 10. As such, disposition of the fluid valve 40 as an external "cartridge" will permit the retrofitting of existing housings with minor, or no modification.

In the embodiment of FIG. 6, the fluidic valve 40 is built as an integral part of the turbocharger turbine casing manufactured by casting or any other known process. As an integral part of the turbocharger 10, the fluidic valve 40 includes a first bore 63 extending from an outer surface of the turbocharger 10 toward the exhaust plenum 34. A passage 64 in flow communication with the first bore 63 is used to drain any rainwater or melted snow accumulated on the exhaust plenum 34. Flow communication of the first bore 63 to the exhaust plenum may also be provided by a second bore having a diameter smaller than that of the first bore 63, as illustrated in the embodiment of FIG. 4. Supply of the compressor bleed air is provided by a jet tube 68 held in place inside of the first bore 63 by a plug or internal fitting 70, which may be threaded into the turbocharger casing or secured by any other know process, including, but not being limited to, welding, brazing, or press fit, to name only a few examples.

Those of ordinary skill in the applicable arts will appreciate, after consideration of the subject matter disclosed herein that performance trade-offs do exist as the various structural features of the fluidic valve 40 are varied in terms of, for example, compressed bleed air flow supply and the ability of the fluidic valve 40 to seal the back flow of exhaust gases from the exhaust plenum 34. For example, jet tubes with larger inside diameters and thru holes with smaller inside diameters will provide a better seal, but require more bleed air and may restrict water drain back from the exhaust plenum. Also, the axial location of the jet tube with respect to the drain will affect performance. For example, a jet tube positioned behind the centerline of the vertical drain enhances water drain flow, but may decrease seal performance. A jet tube positioned forward of drain centerline enhances seal, but may prevent the water to drain properly, thus potentially resulting in flooding of the jet tube. The fluidic valve should be configured to handle turbochargers with high backpressures, i.e., assuring proper sealing as to prevent exhaust gases from leaking. In this regard, air aspirated up through the drain hole will assist in keeping the valve lines from plugging, but the outlet port of the drain may require a screen cover in order to prevent foreign object ingestion into the turbocharger exhaust plenum. In a preferred embodiment, the thru bore diameter is 8.3 mm (0.370 inches), the jet tube has inside and outside diameters of 4 and 5.5 mm (0.180 and 0.250 inches), respectively, and the drain has a diameter of 8.3 mm (0.370 inches). The tip of the jet tube is positioned centered over the vertical drain within ±0.224 mm (±0.010 inches) with a beveled end at 45 degrees. The jet tube may be preferentially offset upward to provide more drain area for water.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments. Finally, in the claims, any means-plus-function clause is intended to cover the structures described herein as performing the recited function and not only structural equivalents, but also equivalent structures. Therefore, the structural features of the fluidic valve 40 illustrated in FIGS. 3-6 and described hereinabove should be interpreted as the means for removing water accumulated in the exhaust plenum of a turbocharger as recited in the claims attached hereto.

What is claimed is:

1. A turbocharger, comprising:

a compressor having an air bleed port;

a turbine connected to the compressor by a mechanical shaft; the turbine being disposed inside an exhaust plenum of the turbocharger; and a fluidic drain valve in flow communication with the air bleed port of the compressor and the exhaust plenum to drain water accumulated therein, wherein the fluidic drain valve is configured to passively drain the water accumulated in the exhaust plenum when no air from the bleed port flows through the fluidic drain valve.

2. The turbocharger according to claim 1, the fluidic drain valve further comprising:

a first hollow body having a first end portion in flow communication with the exhaust plenum;

a second hollow body disposed inside of the first hollow body so as to form a flow passage there between, the second hollow body having a first end portion protruding from a second end portion of the first hollow body, the first end portion of the second hollow body being in flow communication with the air bleed port of the compressor; and a drain in flow communication with the first hollow body, wherein the fluidic drain valve is configured to passively drain the water from the exhaust plenum through the flow passage into the drain when no air from the bleed port flows through the second hollow body and, the fluidic valve is configured to seal a flow of exhaust gases from the exhaust plenum into the drain when air from the bleed port flows through the second hollow body.

3. The turbocharger according to claim 2, wherein a cross sectional area of the first end portion of the first hollow body is smaller than a cross sectional area of the remaining portion of the first hollow body.

4. The turbocharger according to claim 2, wherein a cross sectional area of the first hollow body is substantially constant.

5. The turbocharger according to 2, wherein the fluidic valve is an integral part of the turbocharger.

6. The turbocharger according to claim 2, wherein the fluidic valve is separate from the turbocharger.

7. The turbocharger according to claim 6, wherein the turbocharger is a turbocharger retrofitted with the fluidic valve.

8. The turbocharger according to claim 1, further comprising:

a screen disposed over an outlet of a drain of the fluidic drain valve, the screen being configured to prevent foreign object aspiration into the exhaust plenum when air from the air bleed port flows through the fluidic drain valve.

9. The turbocharger according to claim 2, wherein the second hollow body is offset upward from a centerline of the first hollow body so as to increase a flow area to drain the water.

10. The turbocharger according to claim 2, wherein a tip of a second end portion of the second hollow body is centered over a vertically extending axial axis of the drain.

11. A locomotive comprising the turbocharger according to claim 1.

12. A turbocharger, comprising:

a compressor having an air bleed port;

a turbine connected to the compressor by a mechanical shaft, the turbine being disposed inside an exhaust plenum of the turbocharger; and a fluidic drain valve, comprising, a first body including a bore forming a flow passage, the first body having a first end portion in flow communication with the exhaust plenum, a second body including a bore forming a flow passage, the second body being disposed inside of the first hollow body in a second end portion thereof so as to form a flow passage there between, the second body having a first end portion protruding from a second end portion of the first body, the first end portion of the second body being in flow communication with the air bleed port of the compressor, and a drain in flow communication with the second portion of the first body, wherein the fluidic drain valve is configured to passively drain water from the exhaust plenum through the flow passage between the first and second bodies into the drain when no air from the bleed port flows through the second body and, the fluidic valve is configured to passively seal a flow of exhaust gases from the exhaust plenum into the drain when air from the bleed port flows through the second hollow body.

13. The turbocharger according to 12, wherein the fluidic valve is an integral part of the turbocharger.

14. The turbocharger according to claim 12, wherein the fluidic valve is separate from the turbocharger.

15. The turbocharger according to claim 14, wherein the turbocharger is a turbocharger retrofitted with the fluidic valve.

16. The turbocharger according to claim 12, further comprising:

a screen disposed over an outlet of the drain of the fluidic drain valve, the screen being configured to prevent foreign object aspiration into the exhaust plenum when air from the air bleed port flows through the fluidic drain valve.

17. The turbocharger according to claim 12, wherein the second body is offset upward from a centerline of the first body so as to increase a flow area to drain the water.

18. The turbocharger according to claim 12, wherein a tip of a second end portion of the second body is centered over a vertically extending axial axis of the drain.

19. The turbocharger according to claim 12, wherein the first body includes a first portion with a first diameter and a second portion of a second diameter, the first diameter being smaller than the second diameter or the first body includes a substantially constant cross sectional area.

20. A turbocharger, comprising:

a compressor having an air bleed port;

a turbine connected to the compressor by a mechanical shaft; the turbine being disposed inside an exhaust plenum of the turbocharger; and means for passively removing water accumulated in the exhaust plenum when the turbocharger is not in operation.

* * * * *